US011741905B2

(12) United States Patent
Wen et al.

(10) Patent No.: US 11,741,905 B2
(45) Date of Patent: Aug. 29, 2023

(54) DISPLAY PANEL, DRIVING METHOD FOR SAME, AND DISPLAY DEVICE

(71) Applicants: Chengdu BOE Optoelectronics Technology Co., Ltd., Sichuan (CN); BOE Technology Group Co., Ltd., Beijing (CN)

(72) Inventors: Hui Wen, Beijing (CN); Qing Gong, Beijing (CN); Xu Lu, Beijing (CN); Zhaolun Liu, Beijing (CN)

(73) Assignees: Chengdu BOE Optoelectronics Technology Co., Ltd., Sichuan (CN); BOE Technology Group Co., Ltd., Beijing (CN)

( * ) Notice: Subject to any disclaimer, the term of this patent is extended or adjusted under 35 U.S.C. 154(b) by 166 days.

(21) Appl. No.: 17/435,028

(22) PCT Filed: Feb. 24, 2021

(86) PCT No.: PCT/CN2021/077575
§ 371 (c)(1),
(2) Date: Aug. 30, 2021

(87) PCT Pub. No.: WO2021/212997
PCT Pub. Date: Oct. 28, 2021

(65) Prior Publication Data

US 2022/0328009 A1 Oct. 13, 2022

(30) Foreign Application Priority Data

Apr. 21, 2020 (CN) ..... 202010318072.6

(51) Int. Cl.
*G09G 3/3275* (2016.01)
*G09G 3/3225* (2016.01)

(52) U.S. Cl.
CPC ..... *G09G 3/3275* (2013.01); *G09G 3/3225* (2013.01); *G09G 2300/0426* (2013.01);
(Continued)

(58) Field of Classification Search
CPC .. G09G 3/3275; G09G 3/3225; G09G 3/3266; G09G 2300/0426; G09G 2310/08;
(Continued)

(56) References Cited

U.S. PATENT DOCUMENTS

2001/0050665 A1* 12/2001 Yeo ..... G09G 3/3688 345/87
2006/0012555 A1* 1/2006 Tokumura ..... G09G 3/3648 345/98

(Continued)

FOREIGN PATENT DOCUMENTS

CN 101739935 A 6/2010
CN 105719606 A 6/2016

(Continued)

OTHER PUBLICATIONS

International Search Report for PCT/CN2021/077575 dated May 27, 2021.

(Continued)

*Primary Examiner* — David Tung
(74) *Attorney, Agent, or Firm* — Ling Wu; Stephen Yang; Ling and Yang Intellectual Property

(57) ABSTRACT

A display panel includes a source driving circuit, a multiplexer circuit, and multiple sub-pixels arranged in an array. The multiplexer circuit is configured to, under the control of a first multiplexing signal to an Nth multiplexing signal, control the source driving circuit to be connected with sub-pixels of one or more columns; and in a jth frame, a multiplexing signal turn-on sequence for sub-pixels of an odd row is from a Jth multiplexing signal to sequentially (Continued)

increasing to the Nth multiplexing signal and from the first multiplexing signal to sequentially increasing to a (J−1)th multiplexing signal, and a multiplexing signal turn-on sequence for sub-pixels of an even row is completely opposite to the multiplexing signal turn-on sequence for the sub-pixels of the odd row.

4 Claims, 3 Drawing Sheets

(52) U.S. Cl.
CPC . *G09G 2310/08* (2013.01); *G09G 2320/0233* (2013.01); *G09G 2330/021* (2013.01)

(58) Field of Classification Search
CPC ... G09G 2310/0232; G09G 2310/0283; G09G 2310/0297; G09G 2320/0233; G09G 2330/021; G09G 2380/02
See application file for complete search history.

(56) References Cited

U.S. PATENT DOCUMENTS

| | | | | |
|---|---|---|---|---|
| 2010/0128011 | A1 | 5/2010 | Ito | |
| 2012/0229432 | A1 | 9/2012 | Ueno et al. | |
| 2014/0240379 | A1* | 8/2014 | Jeong | G09G 3/3291 345/691 |
| 2014/0307004 | A1* | 10/2014 | Roh | G09G 3/3208 345/83 |
| 2015/0161956 | A1* | 6/2015 | Lee | G09G 3/3688 438/30 |
| 2016/0180791 | A1 | 6/2016 | Lee et al. | |
| 2018/0090046 | A1* | 3/2018 | Hong | G09G 3/3614 |
| 2018/0277053 | A1 | 9/2018 | Zhao | |
| 2019/0147798 | A1 | 5/2019 | Hwang et al. | |
| 2019/0251908 | A1 | 8/2019 | Kim et al. | |
| 2019/0318699 | A1* | 10/2019 | Zuo | G02F 1/1368 |
| 2019/0347976 | A1 | 11/2019 | Um et al. | |
| 2020/0168158 | A1 | 5/2020 | Zheng et al. | |

FOREIGN PATENT DOCUMENTS

| | | | |
|---|---|---|---|
| CN | 106383624 | A | 2/2017 |
| CN | 106842657 | A | 6/2017 |
| CN | 108335663 | A | 7/2018 |
| CN | 108648680 | A | 10/2018 |
| CN | 109346021 | A | 2/2019 |
| CN | 109884833 | A | 6/2019 |
| CN | 111477180 | A | 7/2020 |

OTHER PUBLICATIONS

Office Action dated Jan. 5, 2021 for Chinese Patent Application No. 202010318072.6 and English Translation.
Office Action dated Jun. 4, 2021 for Chinese Patent Application No. 202010318072.6 and English Translation.
Decision of Rejection dated Sep. 8, 2021 for Chinese Patent Application No. 202010318072.6 and English Translation.

* cited by examiner

DISPLAY PANEL, DRIVING METHOD FOR SAME, AND DISPLAY DEVICE

CROSS-REFERENCE TO RELATED APPLICATIONS

The present application is a U.S. National Phase Entry of International Application No. PCT/CN2021/077575 having an international filing date of Feb. 24, 2021, which claims priority to Chinese patent application No. 2020103180726, filed on Apr. 21, 2020, and entitled "A Display Panel, Driving Method for Same, and Display Device". The entire contents of the above-identified applications are hereby incorporated by reference.

TECHNICAL FIELD

Embodiments of the present disclosure relate, but not limited, to the technical field of display, and particularly to a display panel, a driving method for the same, and a display device.

BACKGROUND

As an active light emitting display device, an Organic Light Emitting Diode (OLED) has the advantages of self-luminance, wide viewing angle, high contrast, relatively low power consumption, extremely quick response, etc. With the constant development of a display technology, an OLED technology has been applied to flexible display devices increasingly.

An OLED is divided into a Passive Matrix Driving OLED (PMOLED) and an Active Matrix Driving OLED (AMOLED) according to a driving manner. An AMOLED display device is expected to replace a Liquid Crystal Display (LCD) as a next-generation novel flat panel display due to its advantages of low manufacturing cost, quick response, power saving, applicability to the direct current driving of a portable device, wide working temperature range, etc.

A multiplexer circuit may be arranged between a source driving circuit and a data line to reduce the number of data lines and improve the resolution of a display panel. 1:2 multiplexing (MUX) is taken as an example. In a multiplexer circuit, sub-pixels are driven row by row according to a turn-on sequence for each row from a first multiplexing signal to a second multiplexing signal. In such a driving manner, the multiplexer circuit repeatedly switches multiplexing signals, which increases the power consumption of the device. In another multiplexer circuit, sub-pixels are driven row by row according to a turn-on sequence for an odd row from a first multiplexing signal to a second multiplexing signal and a turn-on sequence for an even row from the second multiplexing signal to the first multiplexing signal. The power consumption of the device is reduced in such a driving manner. However, the sub-pixels driven by the first multiplexing signal in the first row and the last row are charged for shorter time than the other rows, namely part of sub-pixels of the first row and the last row are under-charged compared with the sub-pixels of the other rows, and it is likely that bright lines are formed at the positions of the first row and the last row.

SUMMARY

The below is a summary about the subject matter described in the present disclosure in detail. The summary is not intended to limit the scope of protection of the claims.

An embodiment of the present disclosure provides a display panel, which includes a source driving circuit, a multiplexer circuit, and multiple sub-pixels arranged in an array. The multiplexer circuit is configured to, under the control of a first multiplexing signal to an Nth multiplexing signal, control the source driving circuit to be connected with sub-pixels of one or more columns. In a jth frame, a multiplexing signal turn-on sequence for sub-pixels of an odd row is from a Jth multiplexing signal to sequentially increasing to the Nth multiplexing signal and from the first multiplexing signal to sequentially increasing to a (J−1)th multiplexing signal, and a multiplexing signal turn-on sequence for sub-pixels of an even row is completely opposite to the multiplexing signal turn-on sequence for the sub-pixels of the odd row. Herein, j is a natural number greater than or equal to 1, $$J = \begin{cases} N, & j \% N = 0 \\ j \% N, & j \% N \neq 0 \end{cases},$$

% is a remainder operator, and N is a natural number greater than 1.

In some possible implementation modes, N is 2. The multiplexer circuit is configured to, under the control of the first multiplexing signal to a second multiplexing signal, control the source driving circuit to be connected with sub-pixels of one or more columns. In an odd frame, a multiplexing signal turn-on sequence for sub-pixels of an odd row is the first multiplexing signal, the second multiplexing signal, and a multiplexing signal turn-on sequence for sub-pixels of an even row is the second multiplexing signal, the first multiplexing signal. In an even frame, a multiplexing signal turn-on sequence for sub-pixels of an odd row is the second multiplexing signal, the first multiplexing signal, and a multiplexing signal turn-on sequence for sub-pixels of an even row is the first multiplexing signal, the second multiplexing signal.

In some possible implementation modes, the multiple sub-pixels include a red sub-pixel, a blue sub-pixel, and a green sub-pixel. Each sub-pixel includes a display element and a switch element. The switch element includes a first transistor. A control electrode of the first transistor is connected with a scanning line, a first electrode of the first transistor is connected with a data line, and a second electrode of the first transistor is connected with the display element. The multiplexer circuit includes a first multiplexing sub-circuit and a second multiplexing sub-circuit.

The first multiplexing sub-circuit includes 2P second transistors. A control electrode of the second transistor is connected with an input terminal of the first multiplexing signal, a first electrode of the second transistor is connected with the source driving circuit, and a second electrode of the second transistor is connected with the data line connected with the red sub-pixel or the blue sub-pixel.

The second multiplexing sub-circuit includes P third transistors. A control electrode of the third transistor is connected with an input terminal of the second multiplexing signal, a first electrode of the third transistor is connected with the source driving circuit, and a second electrode of the third transistor is connected with the data line connected with the green sub-pixel. P is a natural number greater than 1.

In some possible implementation modes, the display element is an organic light emitting diode.

In some possible implementation modes, N is 3. The multiplexer circuit is configured to, under the control of the first multiplexing signal to a third multiplexing signal, control the source driving circuit to be connected with sub-pixels of one or more columns. In a (3M+1)th frame, a multiplexing signal turn-on sequence for sub-pixels of an odd row is the first multiplexing signal, the second multiplexing signal, the third multiplexing signal, and a multiplexing signal turn-on sequence for sub-pixels of an even row is the third multiplexing signal, the second multiplexing signal, the first multiplexing signal. In a (3M+2)th frame, a multiplexing signal turn-on sequence for sub-pixels of an odd row is the second multiplexing signal, the third multiplexing signal, the first multiplexing signal, and a multiplexing signal turn-on sequence for sub-pixels of an even row is the first multiplexing signal, the third multiplexing signal, the second multiplexing signal. In a (3M+3)th frame, a multiplexing signal turn-on sequence for sub-pixels of an odd row is the third multiplexing signal, the first multiplexing signal, and the second multiplexing signal, and a multiplexing signal turn-on sequence for sub-pixels of an even row is the second multiplexing signal, the first multiplexing signal, the third multiplexing signal. M is a natural number greater than or equal to 0.

In some possible implementation modes, the multiple sub-pixels include a red sub-pixel, a blue sub-pixel, and a green sub-pixel. Each sub-pixel includes a display element and a switch element. The switch element includes a first transistor. A control electrode of the first transistor is connected with a scanning line, a first electrode of the first transistor is connected with a data line, and a second electrode of the first transistor is connected with the display element. The multiplexer circuit includes a first multiplexing sub-circuit, a second multiplexing sub-circuit, and a third multiplexing sub-circuit.

The first multiplexing sub-circuit includes Q second transistors. A control electrode of the second transistor is connected with an input terminal of the first multiplexing signal, a first electrode of the second transistor is connected with the source driving circuit, and a second electrode of the second transistor is connected with the data line connected with the red sub-pixel.

The second multiplexing sub-circuit includes Q third transistors. A control electrode of the third transistor is connected with an input terminal of the second multiplexing signal, a first electrode of the third transistor is connected with the source driving circuit, and a second electrode of the third transistor is connected with the data line connected with the blue sub-pixel.

The third multiplexing sub-circuit includes Q fourth transistors. A control electrode of the fourth transistor is connected with an input terminal of the third multiplexing signal, a first electrode of the fourth transistor is connected with the source driving circuit, and a second electrode of the fourth transistor is connected with the data line connected with the green sub-pixel. Q is a natural number greater than 1.

An embodiment of the present disclosure also provides a display device, which includes any abovementioned display panel.

An embodiment of the present disclosure provides a driving method for a display panel. The display panel includes a source driving circuit, a multiplexer circuit, and multiple sub-pixels arranged in an array. The driving method includes: under the control of a first multiplexing signal to an Nth multiplexing signal, controlling the source driving circuit to be connected with sub-pixels of one or more columns. In a jth frame, a multiplexing signal turn-on sequence for sub-pixels of an odd row is from a Jth multiplexing signal to sequentially increasing to the Nth multiplexing signal and from the first multiplexing signal to sequentially increasing to a (J−1)th multiplexing signal, and a multiplexing signal turn-on sequence for sub-pixels of an even row is completely opposite to the multiplexing signal turn-on sequence for the sub-pixels of the odd row. Herein, j is a natural number greater than or equal to 1, $$J = \begin{cases} N, & j \% N = 0 \\ j \% N, & j \% N \neq 0 \end{cases},$$

% is a remainder operator, and N is a natural number greater than 1.

In some possible implementation modes, N is 2. The driving method includes the following contents.

In an odd frame, a multiplexing signal turn-on sequence for sub-pixels of an odd row is the first multiplexing signal, the second multiplexing signal, and a multiplexing signal turn-on sequence for sub-pixels of an even row is the second multiplexing signal, the first multiplexing signal.

In an even frame, a multiplexing signal turn-on sequence for sub-pixels of an odd row is the second multiplexing signal, the first multiplexing signal, and a multiplexing signal turn-on sequence for sub-pixels of an even row is the first multiplexing signal, the second multiplexing signal.

In some possible implementation modes, N is 3. The driving method includes the following contents.

In a (3M+1)th frame, a multiplexing signal turn-on sequence for sub-pixels of an odd row is the first multiplexing signal, the second multiplexing signal, the third multiplexing signal, and a multiplexing signal turn-on sequence for sub-pixels of an even row is the third multiplexing signal, the second multiplexing signal, the first multiplexing signal.

In a (3M+2)th frame, a multiplexing signal turn-on sequence for sub-pixels of an odd row is the second multiplexing signal, the third multiplexing signal, the first multiplexing signal, and a multiplexing signal turn-on sequence for sub-pixels of an even row is the first multiplexing signal, the third multiplexing signal, the second multiplexing signal.

In a (3M+3)th frame, a multiplexing signal turn-on sequence for sub-pixels of an odd row is the third multiplexing signal, the first multiplexing signal, the second multiplexing signal, and a multiplexing signal turn-on sequence for sub-pixels of an even row is the second multiplexing signal, the first multiplexing signal, the third multiplexing signal. M is a natural number greater than or equal to 0.

After the description of the drawings and implementation modes of the embodiments of the present disclosure are read and understood, other aspects can be understood.

BRIEF DESCRIPTION OF DRAWINGS

The drawings provide an understanding to the technical solution of the embodiments of the present disclosure, form a part of the specification, and are adopted to explain, together with the embodiments of the present disclosure, the technical solutions of the present disclosure and not intended to form limits to the technical solutions of the present disclosure.

DETAILED DESCRIPTION

In order to make the purposes, technical solutions, and advantages of the present disclosure clearer, the embodiments of the present disclosure will be described below in combination with the drawings in detail. It is to be noted that the embodiments in the present disclosure and characteristics in the embodiments may be freely combined without conflicts.

Unless otherwise defined, technical terms or scientific terms used in the embodiments of the present disclosure shall have the same meanings as those commonly understood by one of ordinary skill in the art that the present disclosure pertains. "First", "second", and similar terms used in the embodiments of the present disclosure do not represent any sequence, number, or significance but are only adopted to distinguish different components. "Include", "contain", or a similar term means that an element or object appearing before the term covers an element or object and equivalent thereof listed after the term and does not exclude other elements or objects.

It can be understood by those skilled in the art that transistor adopted in all the embodiments of the present disclosure may be a thin film transistor, or a field-effect transistor, or another device with the same characteristic. In some exemplary embodiments, the thin film transistor used in the embodiments of the present disclosure may be an oxide semiconductor transistor. A source and drain of the transistor used here are symmetric, so the drain and the source may be interchanged. In the embodiments of the present disclosure, for distinguishing the two electrodes, except the gate, of the transistor, one electrode is called a first electrode, the other electrode is called a second electrode, the first electrode may be the source or the drain, and the second electrode may be the drain or the source.

Figure 1:
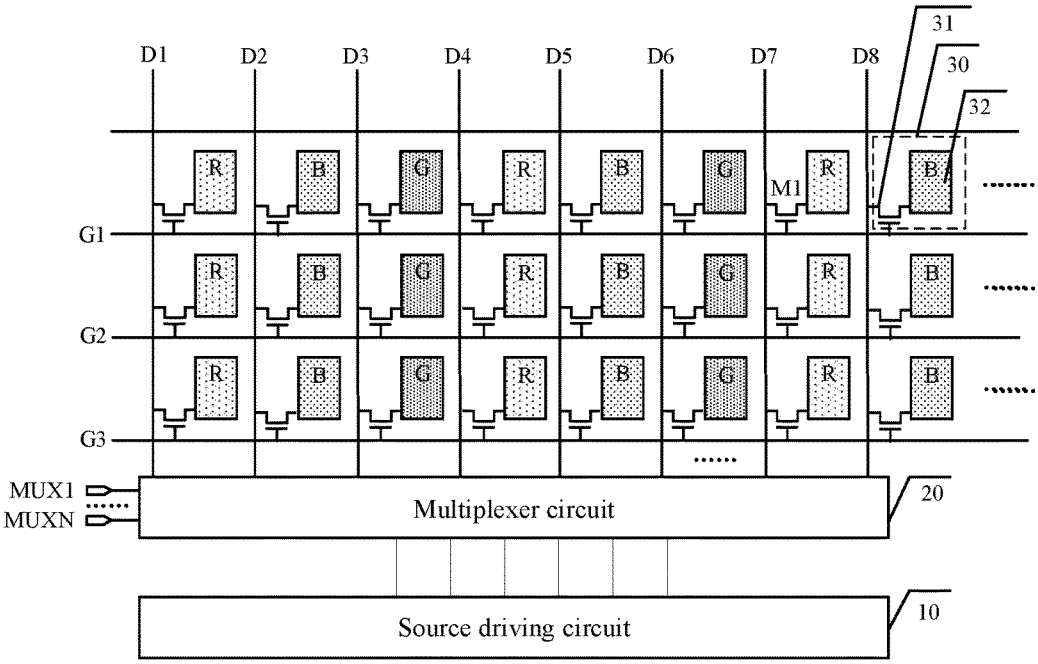
FIG. 1 is a first schematic diagram of structure of a display panel according to an embodiment of the present disclosure.

As shown in FIG. 1, an embodiment of the present disclosure provides a display panel, which includes a source driving circuit 10, a multiplexer circuit 20, and multiple sub-pixels 30 arranged in an array. The multiplexer circuit 20 is configured to, under the control of a first multiplexing signal MUX(1) to an Nth multiplexing signal MUXN, control the source driving circuit 10 to be connected with sub-pixels 30 of one or more columns. In a jth frame, a multiplexing signal turn-on sequence for sub-pixels 30 of an odd row is from a Jth multiplexing signal MUXJ to sequentially increasing to the Nth multiplexing signal MUXN and from the first multiplexing signal MUX(1) to sequentially increasing to a (J−1)th multiplexing signal MUX(J−1), and a multiplexing signal turn-on sequence for sub-pixels 30 of an even row is completely opposite to the multiplexing signal turn-on sequence for the sub-pixels 30 of the odd row. Herein, j is a natural number greater than or equal to 1, $$J = \begin{cases} N, & j \% N = 0 \\ j \% N, & j \% N \neq 0 \end{cases},$$

% is a remainder operator, and N is a natural number greater than 1.

According to the display panel provided in the embodiment of the present disclosure, multiplexing signal driving sequences of an odd row and an even row are complemented, and multiplexing signal driving sequences of first rows and last rows in different frames are complemented, so that each sub-pixel 30 is charged uniformly at the same time of reducing the power consumption, bright lines at the positions of the first row and the last row are eliminated, and the display effect of the display panel is improved.

In an exemplary embodiment, each sub-pixel 30 includes a switch element 31 and a display element 32. The switch element 31 includes a first transistor M1. A control electrode of the first transistor M1 is connected with a scanning line, a first electrode of the first transistor M1 is connected with a data line, and a second electrode of the first transistor M1 is connected with the display element 32.

In an embodiment, the multiple sub-pixels 30 may include a red sub-pixel, a green sub-pixel, and a blue sub-pixel. In another embodiment, the multiple sub-pixels 30 may also include sub-pixels of four or many other colors. For example, the multiple sub-pixels 30 may include a red sub-pixel, a green sub-pixel, a blue sub-pixel, and a white sub-pixel.

In an exemplary embodiment, the display element 32 may be an organic light emitting diode, or a light emitting diode of another type, etc. In practical applications, the structure of the display element 32 may be designed and determined according to a practical application environment, and is not limited herein.

In the embodiment of the present disclosure, the display panel includes a display region and a non-display region. The scanning line, the data line, and the sub-pixel are in the display region. The multiplexer circuit and the source driving circuit are in the non-display region of the display panel.

In an exemplary embodiment, N is 2. The multiplexer circuit 20 is configured to, under the control of the first multiplexing signal MUX(1) to a second multiplexing signal MUX(2), control the source driving circuit 10 to be connected with sub-pixels 30 of one or more columns. In an odd frame, a multiplexing signal turn-on sequence for sub-pixels 30 of an odd row is the first multiplexing signal MUX(1), the second multiplexing signal MUX(2), and a multiplexing signal turn-on sequence for sub-pixels 30 of an even row is the second multiplexing signal MUX(2), the first multiplexing signal MUX(1). In an even frame, a multiplexing signal turn-on sequence for sub-pixels 30 of an odd row is the second multiplexing signal MUX(2), the first multiplexing signal MUX(1), and a multiplexing signal turn-on sequence for sub-pixels 30 of an even row is the first multiplexing signal MUX(1), the second multiplexing signal MUX(2).

Figure 2:
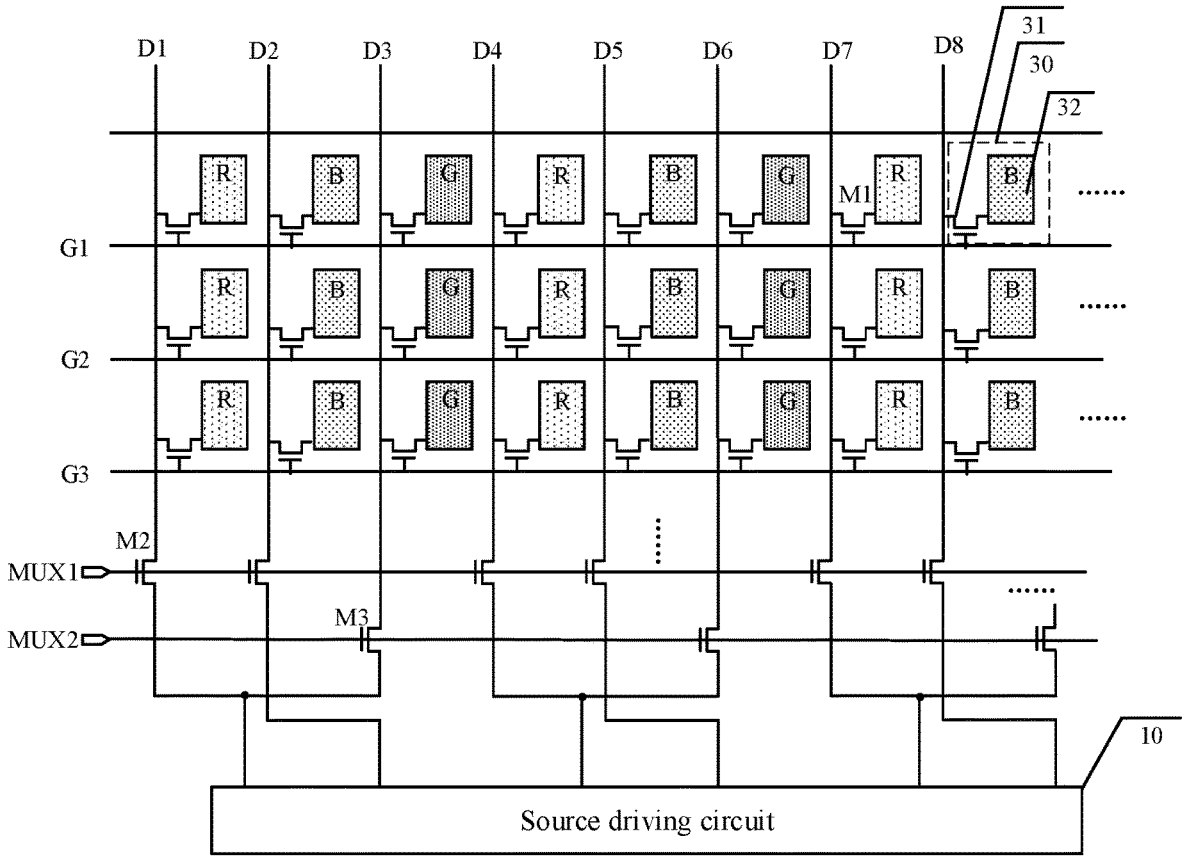
FIG. 2 is a second schematic diagram of structure of a display panel according to an embodiment of the present disclosure.

In an exemplary embodiment, as shown in FIG. 2, the multiplexer circuit 20 includes a first multiplexing sub-circuit and a second multiplexing sub-circuit.

The first multiplexing sub-circuit includes 2P second transistors M2. A control electrode of the second transistor M2 is connected with an input terminal of the first multiplexing signal MUX1, a first electrode of the second transistor M2 is connected with the source driving circuit 10, and a second electrode of the second transistor M2 is connected with the data line connected with the red sub-pixel or the blue sub-pixel.

The second multiplexing sub-circuit includes P third transistors M3. A control electrode of the third transistor M3 is connected with an input terminal of the second multiplexing signal MUX2, a first electrode of the third transistor M3 is connected with the source driving circuit 10, and a second electrode of the third transistor M3 is connected with the data line connected with the green sub-pixel. P is a natural number greater than 1.

In some other embodiments, the second electrode of the second transistor M2 may also be connected with the data line connected with the red sub-pixel or the green sub-pixel, and the second electrode of the third transistor M3 may also be connected with the data line connected with the blue sub-pixel. Alternatively, the second electrode of the second transistor M2 may also be connected with the data line connected with the blue sub-pixel or the green sub-pixel, and the second electrode of the third transistor M3 may also be connected with the data line connected with the red sub-pixel. In practical applications, the structures of the second transistor M2 and the third transistor M3 may be designed and determined according to a practical application environment, and will not be limited herein.

In the present embodiment, all the transistors M1 to M3 may be N-type thin film transistors or P-type thin film transistors. All the transistors M1 to M3 are set to the same type of thin film transistors, so that a process flow may be unified, process procedures may further be reduced, and the yield of the product is helped to be improved. In addition, in some embodiments, considering that a drain current of a low-temperature polysilicon thin film transistor is relatively low, all the transistors in the embodiment of the present disclosure may be low-temperature polysilicon thin film transistors. The thin film transistor may select a thin film transistor of a bottom-gate structure or a thin film transistor of a top-gate structure as long as a switch function may be realized.

Figure 3:
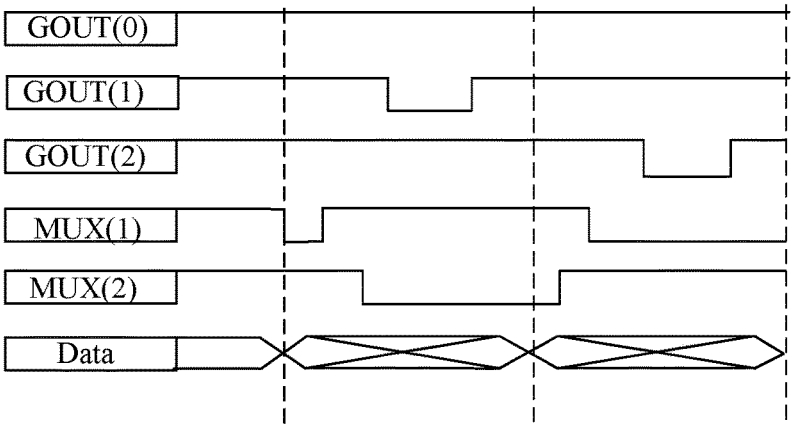
FIG. 3 is a schematic diagram of multiplexing signal driving timing of the display panel shown in FIG. 2 in an odd frame.
Figure 4:
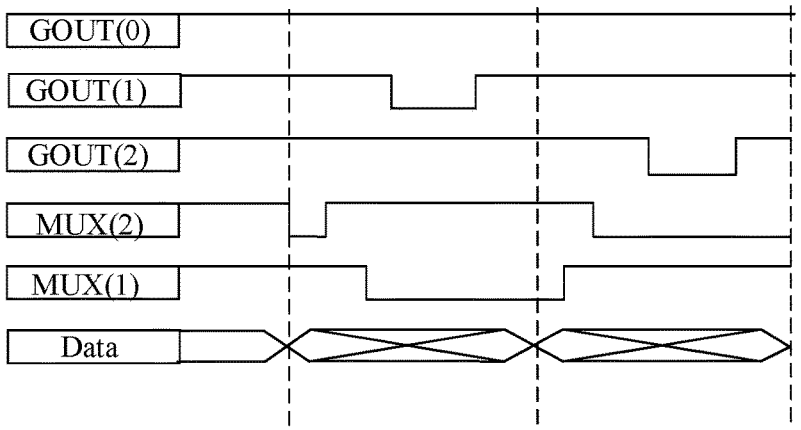
FIG. 4 is a schematic diagram of multiplexing signal driving timing of the display panel shown in FIG. 2 in an even frame.

FIG. 3 is a schematic diagram of multiplexing signal driving timing of the display panel shown in FIG. 2 in an odd frame. FIG. 4 is a schematic diagram of multiplexing signal driving timing of the display panel shown in FIG. 2 in an even frame. A working process of the display panel will now be described in combination with the display panel shown in FIG. 2 and the multiplexing signal driving timing diagrams shown in FIGS. 3 and 4. All the transistors M1 to M3 are, for example, P-type thin film transistors. The P-type thin film transistor is turned on when a potential of a gate terminal decreases, and is turned off when the potential of the gate terminal increases. The working process includes the following operations.

In an odd frame stage, i.e., a stage of a first frame, a third frame, a fifth frame . . . , as shown in FIG. 3, each shift register unit generates and outputs a scanning signal to a scanning line. In such case, a multiplexing signal turn-on sequence for sub-pixels 30 of an odd row is the first multiplexing signal MUX(1), the second multiplexing signal MUX(2). That is, a driving sequence for the sub-pixels 30 of the odd row is that red sub-pixels and blue sub-pixels are driven first and then green sub-pixels are driven. A multiplexing signal turn-on sequence for sub-pixels 30 of an even row is the second multiplexing signal MUX(2), the first multiplexing signal MUX(1). That is, a driving sequence for the sub-pixels 30 of the even row is that green sub-pixels are driven first and then red sub-pixels and blue sub-pixels are driven. The source driving circuit 10 generates corresponding data voltage signals, and outputs the data voltage signals to the corresponding sub-pixels 30 through data lines under the control of the first multiplexing signal MUX(1) and the second multiplexing signal MUX(2).

In an even frame stage, i.e., a stage of a second frame, a fourth frame, a sixth frame . . . , as shown in FIG. 4, each shift register unit generates and outputs a scanning signal to a scanning line. In such case, a multiplexing signal turn-on sequence for sub-pixels 30 of an odd row is the second multiplexing signal MUX(2), the first multiplexing signal MUX(1). That is, a driving sequence for the sub-pixels 30 of the odd row is that green sub-pixels are driven first and then red sub-pixels and blue sub-pixels are driven. A multiplexing signal turn-on sequence for sub-pixels 30 of an even row is the first multiplexing signal MUX(1), the second multiplexing signal MUX(2). That is, a driving sequence for the sub-pixels 30 of the even row is that red sub-pixels and blue sub-pixels are driven first and then green sub-pixels are driven. The source driving circuit 10 generates corresponding data voltage signals, and outputs the data voltage signals to the corresponding sub-pixels 30 through data lines under the control of the first multiplexing signal MUX(1) and the second multiplexing signal MUX(2).

It can be seen from the abovementioned working process that, in the odd frame stage, the multiplexing signal turn-on sequence is the first multiplexing signal MUX(1), the second multiplexing signal MUX(2), the second multiplexing signal MUX(2), the first multiplexing signal MUX(1), the first multiplexing signal MUX(1), the second multiplexing signal MUX(2), the second multiplexing signal MUX(2), the first multiplexing signal MUX(1), abbreviated as 1221122112211221 . . . . In the even frame stage, the multiplexing signal turn-on sequence is the second multiplexing signal MUX(2), the first multiplexing signal MUX (1), the first multiplexing signal MUX(1), the second multiplexing signal MUX(2), the second multiplexing signal MUX(2), the first multiplexing signal MUX(1), the first multiplexing signal MUX(1), the second multiplexing signal MUX(2), abbreviated as 2112211221122112 . . . . It can thus be seen that, in the present embodiment, completely opposite timing is adopted to turn on multiplexing signals for an odd frame and an even frame and for an odd row and an even row to ensure the same turn-on time of different multiplexing signals, so that uniform charging time is ensured for each sub-pixel 30, the luminous efficiency of edge pixels is mutually compensated by odd-even timing alternate control, and the display effect of the module is improved.

In another exemplary embodiment, N is 3.

The multiplexer circuit 20 is configured to, under the control of the first multiplexing signal MUX(1) to a third multiplexing signal MUX(3), control the source driving circuit 10 to be connected with sub-pixels 30 of one or more columns. In a (3M+1)th frame, a multiplexing signal turn-on sequence for sub-pixels 30 of an odd row is the first multiplexing signal MUX(1), the second multiplexing signal MUX(2), the third multiplexing signal MUX(3), and a multiplexing signal turn-on sequence for sub-pixels 30 of an even row is the third multiplexing signal MUX(3), the second multiplexing signal MUX(2), the first multiplexing signal MUX(1). In a (3M+2)th frame, a multiplexing signal turn-on sequence for sub-pixels 30 of an odd row is the second multiplexing signal MUX(2), the third multiplexing signal MUX(3), the first multiplexing signal MUX(1), and a multiplexing signal turn-on sequence for sub-pixels 30 of an even row is the first multiplexing signal MUX(1), the third multiplexing signal MUX(3), the second multiplexing signal MUX(2). In a (3M+3)th frame, a multiplexing signal turn-on sequence for sub-pixels 30 of an odd row is the third multiplexing signal MUX(3), the first multiplexing signal MUX(1), the second multiplexing signal MUX(2), and a multiplexing signal turn-on sequence for sub-pixels 30 of an even row is the second multiplexing signal MUX(2), the first multiplexing signal MUX(1), the third multiplexing signal MUX(3). M is a natural number greater than or equal to 0.

Figure 5:
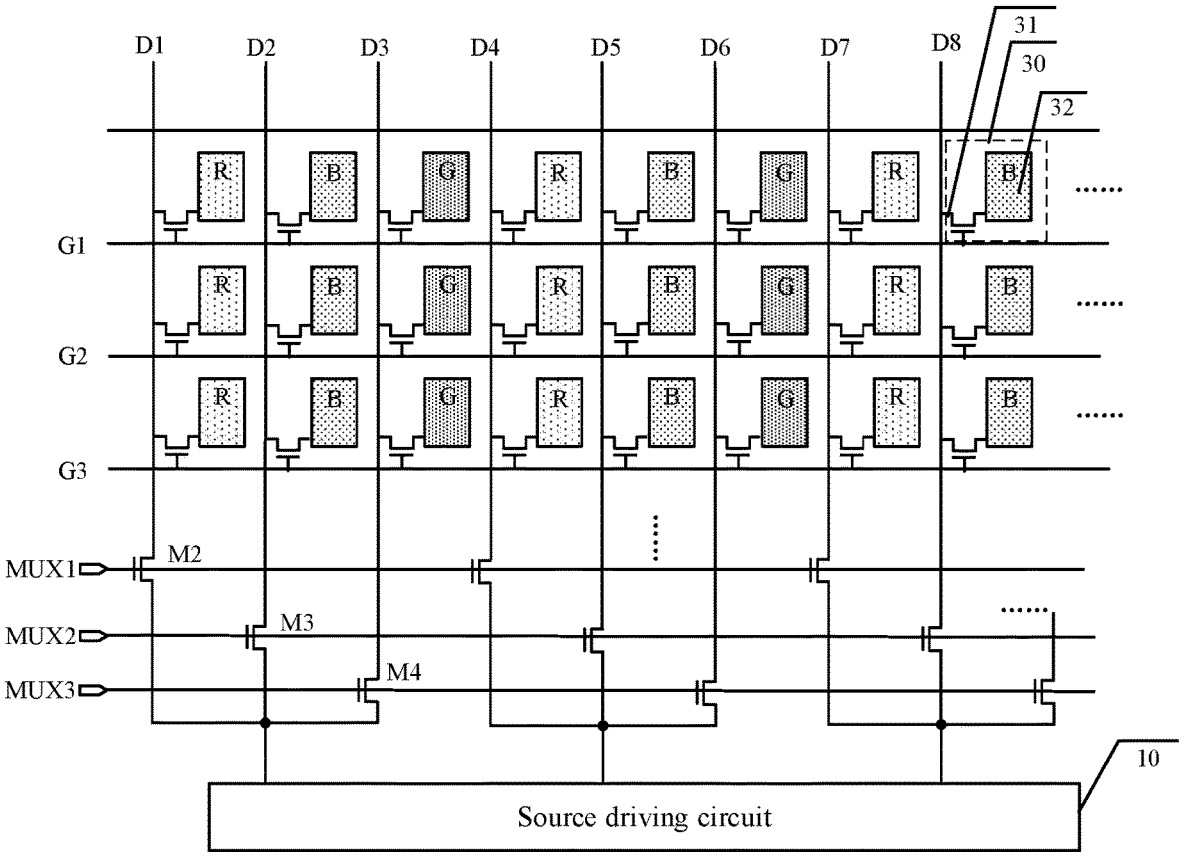
FIG. 5 is a third schematic diagram of structure of a display panel according to an embodiment of the present disclosure.

In an exemplary embodiment, as shown in FIG. 5, the multiplexer circuit 20 includes a first multiplexing sub-circuit, a second multiplexing sub-circuit and a third multiplexing sub-circuit.

The first multiplexing sub-circuit includes Q second transistors M2. A control electrode of the second transistor M2 is connected with an input terminal of the first multiplexing signal MUX1, a first electrode of the second transistor M2 is connected with the source driving circuit 10, and a second electrode of the second transistor M2 is connected with the data line connected with the red sub-pixel.

The second multiplexing sub-circuit includes Q third transistors M3. A control electrode of the third transistor M3 is connected with an input terminal of the second multiplexing signal MUX2, a first electrode of the third transistor M3 is connected with the source driving circuit 10, and a second electrode of the third transistor M3 is connected with the data line connected with the blue sub-pixel.

The third multiplexing sub-circuit includes Q fourth transistors M4. A control electrode of the fourth transistors M4 is connected with an input terminal of the third multiplexing signal MUX3, a first electrode of the fourth transistors M4 is connected with the source driving circuit 10, and a second electrode of the fourth transistors M4 is connected with the data line connected with the green sub-pixel. Q is a natural number greater than 1.

In the present embodiment, all the transistors M1 to M4 may be N-type thin film transistors or P-type thin film transistors. All the transistors M1 to M4 are set to the same type of thin film transistors, so that a process flow may be unified, process procedures may further be reduced, and the yield of the product is helped to be improved. In addition, in some exemplary embodiments, considering that a drain current of a low-temperature polysilicon thin film transistor is relatively low, all the transistors in the embodiment of the present disclosure may be low-temperature polysilicon thin film transistors. The thin film transistor may select a thin film transistor of a bottom-gate structure or a thin film transistor of a top-gate structure as long as a switch function may be realized.

A working process of the display panel when N is 3 may be analogized according to the abovementioned working process when N is 2, and will not be elaborated herein. When N is 3, in the stage of the (3M+1)th frame, the multiplexing signal turn-on sequence is the first multiplexing signal MUX(1), the second multiplexing signal MUX(2), the third multiplexing signal MUX(3), the third multiplexing signal MUX(3), the second multiplexing signal MUX(2), the first multiplexing signal MUX(1), the first multiplexing signal MUX(1), the second multiplexing signal MUX(2), the third multiplexing signal MUX(3), the third multiplexing signal MUX(3), the second multiplexing signal MUX(2), the first multiplexing signal MUX(1) . . . , abbreviated as 123321123321123321123321 . . . . In the stage of the (3M+2)th frame, the multiplexing signal turn-on sequence is the second multiplexing signal MUX(2), the third multiplexing signal MUX(3), the first multiplexing signal MUX(1), the first multiplexing signal MUX(1), the third multiplexing signal MUX(3), the second multiplexing signal MUX(2), the second multiplexing signal MUX(2), the third multiplexing signal MUX(3), the first multiplexing signal MUX(1), the first multiplexing signal MUX(1), the third multiplexing signal MUX(3), the second multiplexing signal MUX(2) . . . , abbreviated as 2311322311322311322311 32 . . . . In the stage of the (3M+3)th frame, the multiplexing signal turn-on sequence is the third multiplexing signal MUX(3), the first multiplexing signal MUX(1), the second multiplexing signal MUX(2), the second multiplexing signal MUX(2), the first multiplexing signal MUX(1), the third multiplexing signal MUX(3), the third multiplexing signal MUX(3), the first multiplexing signal MUX(1), the second multiplexing signal MUX(2), the second multiplexing signal MUX(2), the first multiplexing signal MUX(1), the third multiplexing signal MUX(3) . . . , abbreviated as 3122133122133122133122 13 . . . . It can thus be seen that, in the present embodiment, completely opposite timing is adopted to turn on multiplexing signals for the (3M+1)th frame, the (3M+2)th frame, and the (3M+3)th frame and for an odd row and an even row to ensure the same turn-on time of different multiplexing signals, so that uniform charging time is ensured for each sub-pixel 30, the luminous efficiency of edge pixels is mutually compensated by odd-even timing alternate control, and the display effect of the module is improved.

An embodiment of the present disclosure also provides a driving method for a display panel. The display panel includes a source driving circuit, a multiplexer circuit, and multiple sub-pixels arranged in an array. The driving method includes the following operation.

Under the control of a first multiplexing signal to an Nth multiplexing signal, the source driving circuit is controlled to be connected with sub-pixels of one or more columns. In a jth frame, a multiplexing signal turn-on sequence for sub-pixels of an odd row is from a Jth multiplexing signal to sequentially increasing to the Nth multiplexing signal and from the first multiplexing signal to sequentially increasing to a (J−1)th multiplexing signal, and a multiplexing signal turn-on sequence for sub-pixels of an even row is completely opposite to the multiplexing signal turn-on sequence for the sub-pixels of the odd row. Herein j is a natural number greater than or equal to 1, $$J = \begin{cases} N, & j \% N = 0 \\ j \% N, & j \% N \neq 0 \end{cases},$$

% is a remainder operator, and N is a natural number greater than 1.

In an exemplary embodiment, N is 2. The driving method includes the following contents.

In an odd frame, a multiplexing signal turn-on sequence for sub-pixels of an odd row is the first multiplexing signal, the second multiplexing signal, and a multiplexing signal turn-on sequence for sub-pixels of an even row is the second multiplexing signal, the first multiplexing signal.

In an even frame, a multiplexing signal turn-on sequence for sub-pixels of an odd row is the second multiplexing signal, the first multiplexing signal, and a multiplexing signal turn-on sequence for sub-pixels of an even row is the first multiplexing signal, the second multiplexing signal.

In an exemplary embodiment, N is 3. The driving method includes the following contents.

In a (3M+1)th frame, a multiplexing signal turn-on sequence for sub-pixels of an odd row is the first multiplexing signal, the second multiplexing signal, the third multiplexing signal, and a multiplexing signal turn-on sequence for sub-pixels of an even row is the third multiplexing signal, the second multiplexing signal, the first multiplexing signal.

In a (3M+2)th frame, a multiplexing signal turn-on sequence for sub-pixels of an odd row is the second multiplexing signal, the third multiplexing signal, the first multiplexing signal, and a multiplexing signal turn-on sequence for sub-pixels of an even row is the first multiplexing signal, the third multiplexing signal, the second multiplexing signal.

In a (3M+3)th frame, a multiplexing signal turn-on sequence for sub-pixels of an odd row is the third multiplexing signal, the first multiplexing signal, the second multiplexing signal, and a multiplexing signal turn-on sequence for sub-pixels of an even row is the second multiplexing signal, the first multiplexing signal, the third multiplexing signal. M is a natural number greater than or equal to 0.

Some embodiments of the present disclosure also provide a display device, which includes a display panel.

Optionally, the display device may be any product or component with a display function, such as an OLED panel, a mobile phone, a tablet computer, a television, a display, a notebook computer, a digital photo frame, and a navigator. No limits are made thereto in the embodiment of the present disclosure.

The display panel is the display panel provided in the abovementioned embodiment, and has a similar implementation principle and implementation effect. Elaborations are omitted herein.

The following points need to be noted.

The drawings of the embodiments of the present disclosure only involve the structures involved in the embodiments of the present disclosure, and the other structures may refer to conventional designs.

The embodiments in the present disclosure, i.e., the features in the embodiments, can be combined without conflicts to obtain new embodiments.

Although the implementation modes of the present disclosure are disclosed above, the contents are only implementation modes adopted to easily understand the present disclosure and not intended to limit the present disclosure. Those skilled in the art may make any modifications and variations to implementation forms and details without departing from the spirit and scope disclosed by the present disclosure. However, the patent protection scope of the present disclosure should also be subject to the scope defined by the appended claims.

What is claimed is:

1. A display panel, comprising a source driving circuit, a multiplexer circuit, and multiple sub-pixels arranged in an array, wherein the multiplexer circuit is configured to, under the control of the first multiplexing signal to the second multiplexing signal, control the source driving circuit to be connected with sub-pixels of one or more columns; wherein in an odd frame, a multiplexing signal turn-on sequence for sub-pixels of an odd row is the first multiplexing signal, the second multiplexing signal, and a multiplexing signal turn-on sequence for sub-pixels of an even row is the second multiplexing signal, the first multiplexing signal; and in an even frame, a multiplexing signal turn-on sequence for sub-pixels of an odd row is the second multiplexing signal, the first multiplexing signal, and a multiplexing signal turn-on sequence for sub-pixels of an even row is the first multiplexing signal, the second multiplexing signal;

wherein the multiple sub-pixels comprise a red sub-pixel, a blue sub-pixel, and a green sub-pixel; each sub-pixel comprises a display element and a switch element; the switch element comprises a first transistor; a control electrode of the first transistor is connected with a scanning line, a first electrode of the first transistor is connected with a data line, and a second electrode of the first transistor is connected with the display element; the multiplexer circuit comprises a first multiplexing sub-circuit and a second multiplexing sub-circuit; wherein the first multiplexing sub-circuit comprises 2P second transistors; a control electrode of the second transistor is connected with an input terminal of the first multiplexing signal, a first electrode of the second transistor is connected with the source driving circuit, and a second electrode of the second transistor is connected with the data line connected with the red sub-pixel or the blue sub-pixel;

the second multiplexing sub-circuit comprises P third transistors; a control electrode of the third transistor is connected with an input terminal of the second multiplexing signal, a first electrode of the third transistor is connected with the source driving circuit, and a second electrode of the third transistor is connected with the data line connected with the green sub-pixel, P being a natural number greater than 1.

2. The display panel according to claim 1, wherein the display element is an organic light emitting diode.

3. A display device, comprising the display panel according to claim 1.

4. A driving method for a display panel, the display panel comprising a source driving circuit, a multiplexer circuit, and multiple sub-pixels arranged in an array, the driving method comprising:

in an odd frame, a multiplexing signal turn-on sequence for sub-pixels of an odd row is the first multiplexing signal, the second multiplexing signal, and a multiplexing signal turn-on sequence for sub-pixels of an even row is the second multiplexing signal, the first multiplexing signal; and in an even frame, a multiplexing signal turn-on sequence for sub-pixels of an odd row is the second multiplexing signal, the first multiplexing signal, and a multiplexing signal turn-on sequence for sub-pixels of an even row is the first multiplexing signal, the second multiplexing signal;

wherein the multiple sub-pixels comprise a red sub-pixel, a blue sub-pixel, and a green sub-pixel; each sub-pixel comprises a display element and a switch element; the switch element comprises a first transistor; a control electrode of the first transistor is connected with a scanning line, a first electrode of the first transistor is connected with a data line, and a second electrode of the first transistor is connected with the display element; the multiplexer circuit comprises a first multiplexing sub-circuit and a second multiplexing sub-circuit; wherein the first multiplexing sub-circuit comprises 2P second transistors; a control electrode of the second transistor is connected with an input terminal of the first multiplexing signal, a first electrode of the second transistor is connected with the source driving circuit, and a second electrode of the second transistor is connected with the data line connected with the red sub-pixel or the blue sub-pixel;

the second multiplexing sub-circuit comprises P third transistors; a control electrode of the third transistor is connected with an input terminal of the second multiplexing signal, a first electrode of the third transistor is connected with the source driving circuit, and a second electrode of the third transistor is connected with the data line connected with the green sub-pixel, P being a natural number greater than 1.

* * * * *